US009857738B2

(12) United States Patent
Saito et al.

(10) Patent No.: US 9,857,738 B2
(45) Date of Patent: Jan. 2, 2018

(54) FIXING DEVICE AND IMAGE FORMING APPARATUS

(71) Applicant: KONICA MINOLTA, INC., Chiyoda-ku, Tokyo (JP)

(72) Inventors: Keita Saito, Toyokawa (JP); Noboru Oomoto, Toyokawa (JP); Shinichi Yabuki, Toyokawa (JP); Tadayasu Sekioka, Toyohashi (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 15/159,510

(22) Filed: May 19, 2016

(65) Prior Publication Data

US 2016/0357144 A1 Dec. 8, 2016

(30) Foreign Application Priority Data

Jun. 2, 2015 (JP) ..... 2015-112298

(51) Int. Cl.
*G03G 15/20* (2006.01)
*G03G 21/20* (2006.01)

(52) U.S. Cl.
CPC ..... *G03G 15/2017* (2013.01); *G03G 15/2039* (2013.01); *G03G 21/206* (2013.01); *G03G 2215/2032* (2013.01)

(58) Field of Classification Search
CPC ..... G03G 15/2017; G03G 15/2021; G03G 15/2039; G03G 15/2046; G03G 15/2078; G03G 21/206
See application file for complete search history.

(56) References Cited

U.S. PATENT DOCUMENTS 3,998,584 A * 12/1976 Wada ..... G03G 15/2032 100/327
4,618,240 A * 10/1986 Sakurai ..... G03G 15/2053 219/216
4,963,943 A * 10/1990 Tamary ..... G03G 15/2039 399/335

(Continued)

FOREIGN PATENT DOCUMENTS

JP 61039075 A * 2/1986
JP 2000221817 A * 8/2000

(Continued)

OTHER PUBLICATIONS

Machine translation of JP 2000-221817. Aug. 11, 2000.*

(Continued)

*Primary Examiner* — David M Gray
*Assistant Examiner* — Carla Therrien
(74) *Attorney, Agent, or Firm* — Buchanan Ingersoll & Rooney PC

(57) ABSTRACT

In a fixing device for fixing a toner image to a recording medium by heating and pressing the recording medium with transferred toner image between a heat fixing member and a pressure member, a fixing-member housing is disposed on an outer peripheral side of the heat fixing member, while a reflection member is attached to an inner side of the fixing-member housing opposed to the heat fixing member. Air blown by an air blower is circulated through space between the fixing-member housing and the heat fixing member.

11 Claims, 3 Drawing Sheets

(56) References Cited

U.S. PATENT DOCUMENTS

| | | | | |
|---|---|---|---|---|
| 5,325,158 | A * | 6/1994 | Guelfo | B41J 29/377 355/30 |
| 7,778,582 | B2 * | 8/2010 | Miki | G03G 15/2064 399/329 |
| 8,626,045 | B2 * | 1/2014 | Matsuura | G03G 15/2064 399/328 |
| 2007/0122177 | A1 | 5/2007 | Doi | |
| 2013/0302073 | A1 * | 11/2013 | Takeuchi | G03G 15/2039 399/328 |
| 2014/0363192 | A1 * | 12/2014 | Hashimoto | G03G 21/206 399/93 |
| 2015/0261148 | A1 * | 9/2015 | Yamaguchi | G03G 15/2017 399/329 |
| 2015/0268606 | A1 * | 9/2015 | Hayase | G03G 15/2053 399/330 |

FOREIGN PATENT DOCUMENTS

| | | | |
|---|---|---|---|
| JP | 2004-109626 | A | 4/2004 |
| JP | 2006-058695 | A | 3/2006 |
| JP | 2007-171921 | A | 7/2007 |

OTHER PUBLICATIONS

Office Action (Notification of Reason(s) for Refusal) dated Jun. 6, 2017, by the Japanese Patent Office in corresponding Japanese Patent Application No. 2015-112298, and an English Translation of the Office Action. (8 pages).

* cited by examiner

FIXING DEVICE AND IMAGE FORMING APPARATUS

RELATED APPLICATION

The priority application Number Japanese Patent Application 2015-112298 upon which this application is based is hereby incorporated by reference.

BACKGROUND OF THE INVENTION

Field of the Invention

The present invention relates to a fixing device and an image forming apparatus including the same. The fixing device fixes a toner image to a recording medium by heating and pressing the recording medium with transferred toner image between a heat fixing member and a pressure member opposed to this heat fixing member. Particularly, the invention is directed to an effective utilization of the heat of the heat fixing member so as to achieve adequate reduction of the power consumption of the fixing device.

Description of the Related Art

In electrophotographic image forming apparatuses such as copiers, printers, facsimiles and multi-functional peripheries thereof, an operation is commonly performed to transport the recording medium with transferred toner image from an image carrier such as a photoreceptor to the fixing device, which fixes the toner image to the recording medium.

Such a fixing device generally has an arrangement where the toner image is fixed to the recording medium by heating and pressing the recording medium with transferred toner image between the heat fixing member and the pressure member opposed to this heat fixing member.

However, the conventional fixing devices have the following problem. The fixing device does not effectively utilize the heat of the heat fixing member serving to heat and press the recording medium with transferred toner image, and releases the heat to the outside. Thus, the fixing device fails to reduce the power consumption. Further, the surrounding temperature of the fixing device is raised by the heat released as described above, adversely affecting image formation.

Heretofore, there is known a fixing device which prevents vapor occurring in the heat fixing process from leaking from the fixing device while condensing the vapor for easy moisture removal and reduction of extra exhaust heat. That is, the fixing device achieves resource saving and is less likely to degrade office environment. As suggested in Patent Document 1 (JP-A No. 2006-58695), such a fixing device is provided with a cover member for covering a transport path for the recording medium. Disposed in this cover member is fixing means including the heat fixing member and pressure member which heat and press the recording medium with transferred toner image. Air containing the vapor occurring in the heat fixing process is sucked by air suction means and circulated in a circulation flow path of a reflux duct such that the heat of the vapor-containing air circulated through the circulation flow path is released to the outside by means of heat releasing means.

However, even the fixing device disclosed in the patent document 1 fails to effectively utilize the heat of the heat fixing member. The problem of the fixing device that cannot achieve the reduction of power consumption and such still remain unsolved.

The fixing device as described above may adopt the following structure for effective utilization of the heat of the heat fixing member for heating and pressing the recording medium with transferred toner image. The structure is made such that a fixing-member housing is disposed on an outer peripheral side of the heat fixing member while a reflection member is attached to an inner side of this fixing-member housing opposed to the heat fixing member. The reflection member reflects the heat released from the heat fixing member so as to enhance heat retention of the heat fixing member. Thus, the fixing device is reduced in the power consumption.

However, the following problem is encountered by the fixing device where the toner image is fixed to the recording medium by heating and pressing the recording medium with transferred toner image between the heat fixing member and the pressure member opposed to this heat fixing member. This image fixing operation entails the generation of foreign substances including volatile organic compounds (VOC), ultrafine particles (UFP), toner powder, paper dust and the like. These foreign substances adhere to a surface of the reflection member on the inner side of the fixing-member housing and hence, the heat released from the heat fixing member is not reflected but absorbed by the adherent foreign substances. Accordingly, the heat fixing member cannot be fully improved in the heat retention, making it difficult to fully reduce the power consumption of the fixing device.

SUMMARY OF THE INVENTION

According to an aspect of the invention, a fixing device which includes a heat fixing member and a pressure member opposed to the heat fixing member, and which fixes a toner image to a recording medium by heating and pressing the recording medium with transferred toner image between the heat fixing member and the pressure member, the fixing device further includes a fixing-member housing disposed on an outer peripheral side of the heat fixing member, and a reflection member attached to an inner side of the fixing-member housing opposed to the heat fixing member, and has a structure wherein air blown by an air blower is circulated through space between the fixing-member housing and the heat fixing member.

An image forming apparatus according to an aspect of the invention employs the above-described fixing device for fixing the toner image to the recording medium.

These and other objects, advantages and features of the invention will become apparent from the following description thereof taken in conjunction with the accompanying drawings which illustrate specific embodiments of the invention.

DESCRIPTION OF THE PREFERRED EMBODIMENT

Figure 1:
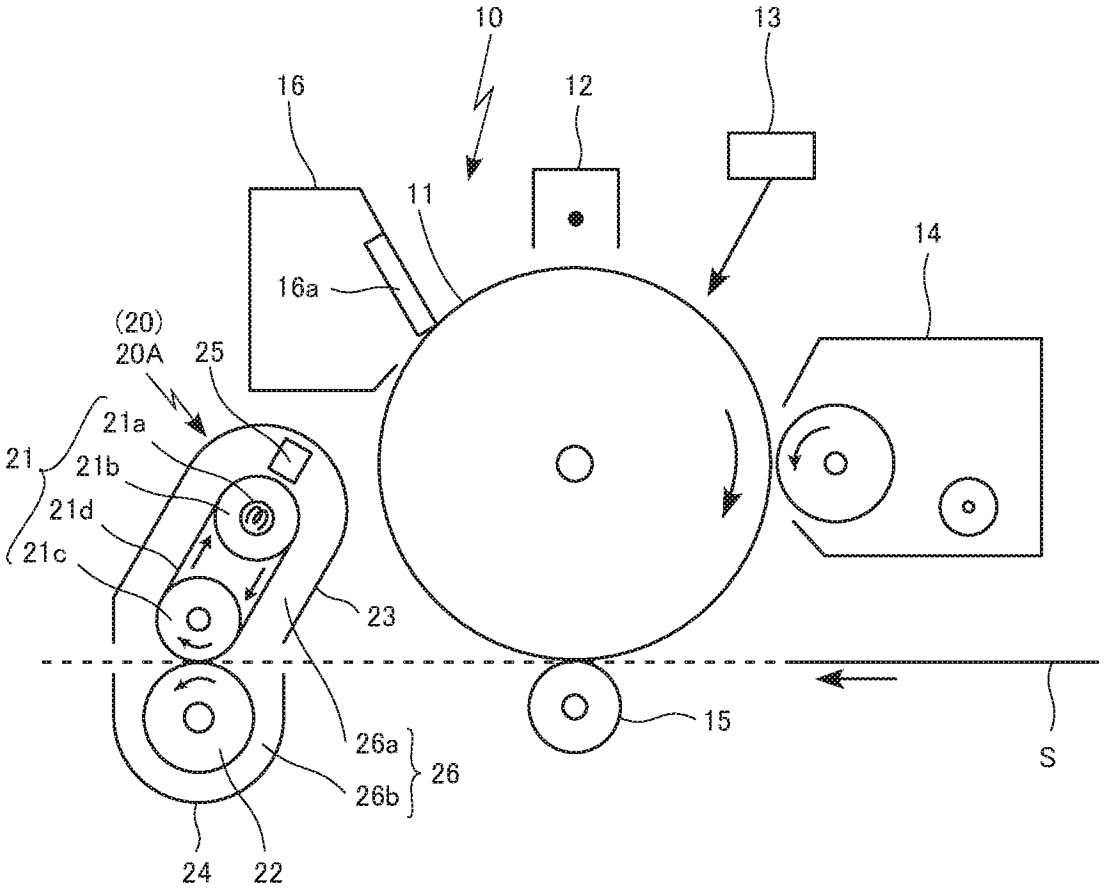
FIG. 1 is a schematic diagram illustrating an example where an image forming apparatus employing a fixing device according to a first embodiment of the invention is operated for image formation.

In a fixing device according to the invention, a toner image is fixed to a recording medium by heating and pressing the recording medium with transferred toner image between a heat fixing member and a pressure member opposed to the heat fixing member. The fixing device has a structure where a fixing-member housing is disposed on an outer peripheral side of the heat fixing member while a reflection member is attached to an inner side of the fixing-member housing opposed to the heat fixing member. Air blown by an air blower is circulated through space between the fixing-member housing and the heat fixing member.

According to the above-described structure where the fixing-member housing is disposed on the outer peripheral side of the heat fixing member for heating and pressing the recording medium with transferred toner image while the reflection member is attached to the inner side of the fixing-member housing opposed to the heat fixing member, this reflection member reflects the heat released from the heat fixing member so as to enhance the heat retention of the heat fixing member.

Further, the air blown by the air blower is circulated through space between the fixing-member housing and the heat fixing member. In conjunction with the air circulated in this manner, the foreign substances such as volatile organic compounds generated during the image fixing operation are circulated and hence, such foreign substances are prevented from adhering to a surface of the reflection member attached to the inner side of the fixing-member housing.

Furthermore, a pressure-member housing may be disposed on an outer peripheral side of the pressure member such that the air blown by the air blower can be circulated through the space between the fixing-member housing and the heat fixing member and the space between the pressure-member housing and the pressure member. In the case where the pressure-member housing is disposed on the outer peripheral side of the pressure member, it is preferred to attach a reflection member to an inner side of the pressure-member housing opposed to the heat pressure member so as to enhance the heat retention of the whole body of the fixing device.

Alternatively, an outer peripheral housing may be disposed on an outer peripheral side of the fixing-member housing so as to allow the air blown by the air blower to be circulated through the space between the fixing-member housing and the heat fixing member and the space between the outer peripheral housing and the fixing-member housing. In the case where the outer peripheral housing is disposed on the outer peripheral side of the fixing-member housing, it is preferred to attach a reflection member to an inner side of the outer peripheral housing so as to enhance the heat retention of the whole body of the fixing device.

Further, a filter member may be disposed in a circulation path for circulation of the air blown by the air blower. According to this arrangement, the foreign substances such as the volatile organic compounds generated during the image fixing operation are collected by the above filter member so that the adhesion of the foreign substances to the surface of the reflection member on the inner side of the fixing-member housing and the like is suppressed. In the case where the filter member is disposed in the circulation path, it is preferred to provide a guide member for guiding the air circulated through the circulation path to the filter member in order to ensure that the above-described foreign substances such as the volatile organic compounds are properly carried by the blown air to the filter member.

Further, the fixing device may be provided with an air exhaust for discharging, to the outside, the air circulated as blown by the air blower.

Next, a fixing device and an image forming apparatus according to the embodiment of the invention are specifically described with reference to the accompanying drawings. It is noted that the fixing device and the image forming apparatus according to the invention are not limited to the following embodiments but may be otherwise variously embodied without departing from the scope of the invention.

In an image forming apparatus 10 according to the embodiment of the invention, as shown in FIG. 1, a surface of a rotating photoreceptor 11 is electrically charged by a charger unit 12. The charged surface of the photoreceptor 11 is exposed to light according to image information by means of an exposure unit 13. Thus, an electrostatic latent image is formed on the surface of the photoreceptor 11.

While the charger unit 12 employs a scorotron charger, the charger unit may also employ a roller-like charging member, blade-like charging member, brush-like charging member and the like. Further, the exposure unit 13 may employ alight source such as an on-off switchable laser, LED and the like.

A developing unit 14 supplies a toner to the area of the electrostatic latent image formed on the photoreceptor 11 as described above, so as to forma toner image on the surface of the photoreceptor 11 in correspondence to the electrostatic latent image.

Subsequently, the toner image thus formed on the photoreceptor 11 is delivered to a position of a transfer unit 13 employing a transfer roller while a recording medium S is fed to space between this photoreceptor 11 and the transfer unit 13. A transfer bias voltage from a transfer bias supply (not shown) is applied to the transfer unit 13, which is enabled to transfer the toner image formed on the photoreceptor 11 to the recording medium S.

After the transfer of the toner image to the recording medium S, the photoreceptor 11 is moved to a cleaning unit 16 where a cleaning member 16*a* including a cleaning blade disposed at the cleaning unit 16 cleans the photoreceptor surface 11 by removing residues such as the toner not transferred to the recording medium S and remaining on the photoreceptor surface 11.

Further, the recording medium S with transferred toner image as described above is delivered to a fixing device 20 where the toner image is fixed to the recording medium S by heating and pressing the recording medium S with transferred toner image between a heat fixing member 21 disposed in this fixing device and a pressure member 22 opposed to this heat fixing member 21.

Figure 2:
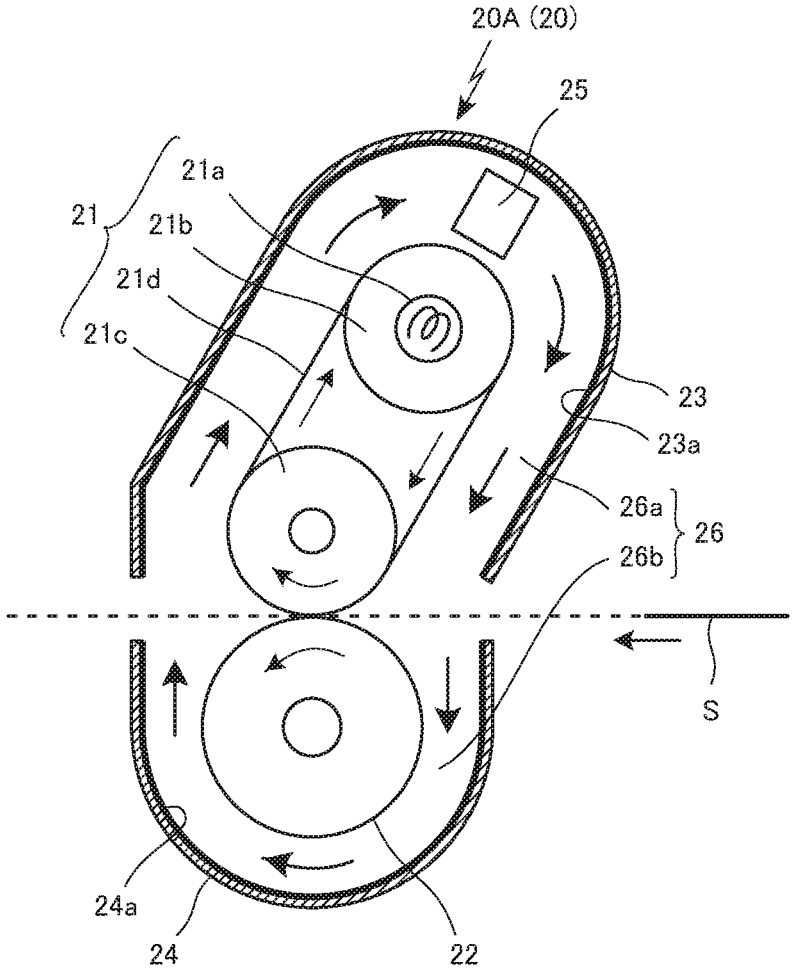
FIG. 2 is a schematic diagram illustrating how the first fixing device is operated.

In a first fixing device 20A (20) shown in FIG. 1 and FIG. 2, a rotatably driven pressure roller 22 is employed as the above pressure member 22 while an endless fixing belt 21*d* entrained between a heat roller 21*b* containing therein a heating element 21*a* such as a halogen heater and a fixing roller 21*c* for pressing the belt against the above pressure roller 22 is employed as the heat fixing member 21.

In conjunction with the rotation of the pressure roller 22, the fixing belt 21*d* is rotatably driven by means of the fixing roller 21*c* so that the recording medium S with transferred toner image is heated and pressed between the fixing belt 21*d* heated by the heat roller 21*b* and the pressure roller 22. Thus, the toner image is fixed to the recording medium S.

An elastic roller, a sponge roller and the like are applicable to the pressure roller 22 and the fixing roller 21*c* such that the recording medium S with transferred toner image can be adequately nipped between the pressure roller 22 and the fixing belt 21*d* pressed by means of the fixing roller 21*c*. Further, the heating element 21*a* is not limited to the halogen heater and may employ any known heating elements such as IH heater and microwave heater. In addition, it is also possible to dispose such a heating element externally of the heat roller, an illustration of which is dispensed with.

In the first fixing device 20A, the endless fixing belt 21*d* entrained between the heat roller 21*b* provided with the heating element 21*a* and the fixing roller 21*c* is employed as the heat fixing member 21. However, the heat fixing member is not limited to this. The heat fixing member may also consist of only the heat fixing roller containing therein the heating element, the illustration of which is dispensed with.

In the first fixing device 20A, a fixing-member housing 23 is disposed on an outer peripheral side of the heat fixing member 21 including the fixing belt 21*d* entrained between the heat roller 21*b* and the fixing roller 21*c* in a manner to extend along the outer periphery of the heat fixing member 21 via a predetermined distance therebetween. Further, a reflection member 23*a* is attached to an inner side of the fixing-member housing 23 opposed to the heat fixing member 21 such that this reflection member 23*a* can enhance the heat retention of the heat fixing member 21 by reflecting heat released from the heat fixing member 21.

In addition, a pressure-member housing 24 is also disposed on an outer peripheral side of the pressure roller 22 in a manner to extend along the outer periphery of the pressure roller 22 via a predetermined distance therebetween. Further, a reflection member 24*a* is attached to an inner side of the pressure-member housing 24 opposed to the pressure roller 22 such that this reflection member 24*a* can enhance the heat retention of the pressure roller 22 by reflecting heat released from the pressure roller 22.

It is noted here that the fixing-member housing 23 and the pressure-member housing 24 are generally formed by working a sheet metal having a thickness on the order of 0.8 mm. The reflection member 23*a* attached to the inner side of the fixing-member housing 23 and the reflection member 24*a* attached to the inner side of the pressure-member housing 24 may be a metal film such as of Al, Fe, Cu, Ag, Au or the like, a dielectric multi-layer or the like. It is preferred to use a metal film of Al or Fe from the standpoint of manufacturing costs.

As described above, the fixing-member housing 23 with the reflection member 23*a* attached to the inner side thereof is extended along the heat fixing member 21 via the predetermined distance therebetween, while the pressure-member housing 24 with the reflection member 24*a* attached to the inner side thereof is extended along the pressure roller 22 via the predetermined distance therebetween. In order to ensure that the heat from the heat fixing member 21 and the pressure roller 22 is properly reflected by the reflection member 23*a* on the fixing-member housing 23 and the reflection member 24*a* on the pressure-member housing 24 so as to adequately enhance the heat retention of the heat fixing member 21 and the pressure roller 22, it is preferred to make the following arrangement. In a case where the temperature of the heat fixing member 21 and the pressure roller 22 is in the range of 180 to 200° C., for example, the distance between the reflection member 23*a* on the fixing-member housing 23 and the heat fixing member 21 or the distance between reflection member 24*a* on the pressure-member housing 24 and the pressure roller 22 is defined to be on the order of 7 mm.

In the first fixing device 20A, an air blower 25 employing a fan or the like is disposed in a space defined between the fixing-member housing 23 and the heat fixing member 21. This air blower 25 blows air for air circulation through a circulation path 26 including a fixing-member side circulation portion 26*a* defined between the fixing-member housing 23 and the heat fixing member 21 and a pressure-member side circulation portion 26*b* defined between the pressure-member housing 24 and the pressure roller 22.

In the first fixing device 20A, the fixing-member housing 23 is extended along the heat fixing member 21 via the predetermined distance therebetween while the pressure-member housing 24 is extended along the pressure roller 22 via the predetermined distance therebetween. Therefore, the air blown by the air blower 25 is properly circulated through the fixing-member side circulation portion 26*a* and the pressure-member side circulation portion 26*b*. Furthermore, in the fixing-member side circulation portion 26*a* defined between the fixing-member housing 23 and the heat fixing member 21, the air blown by the air blower 25 flows in a moving direction of the fixing belt 21*d* of the heat fixing member 21 so that the fixing-member side circulation portion 26*a* can accomplish more proper air circulation.

If the air blower 25 blows the air so as to circulate the air through the circulation path 26 including the fixing-member side circulation portion 26*a* and the pressure-member side circulation portion 26*b*, the foreign substances such as the volatile organic compounds, ultrafine particles, toner powder, and paper dust that occur during fixing of the toner image to the recording medium S are circulated through the circulation path 26 as born on the air flow. Thus, these foreign substances are prevented from adhering to the reflection member 23*a* on the inner side of the fixing-member housing 23 and the reflection member 24*a* on the inner side of the pressure-member housing 24.

Accordingly, the first fixing device 20A is adapted to prevent the adhesion of the foreign substances to the reflection member 23*a* on the inner side of the fixing-member housing 23 and the reflection member 24*a* on the inner side of the pressure-member housing 24, thus preventing the heat released from the heat fixing member 21 and the pressure roller 22 from being absorbed by the foreign substances. The heat released from the heat fixing member 21 and the pressure roller 22 is adequately reflected by the individual reflection members 23*a*, 24*a* so that the heat fixing member 21 and the pressure roller 22 are fully improved in the heat retention. Furthermore, the fixing device 20A as a whole can efficiently reduce power consumption.

Figure 3:
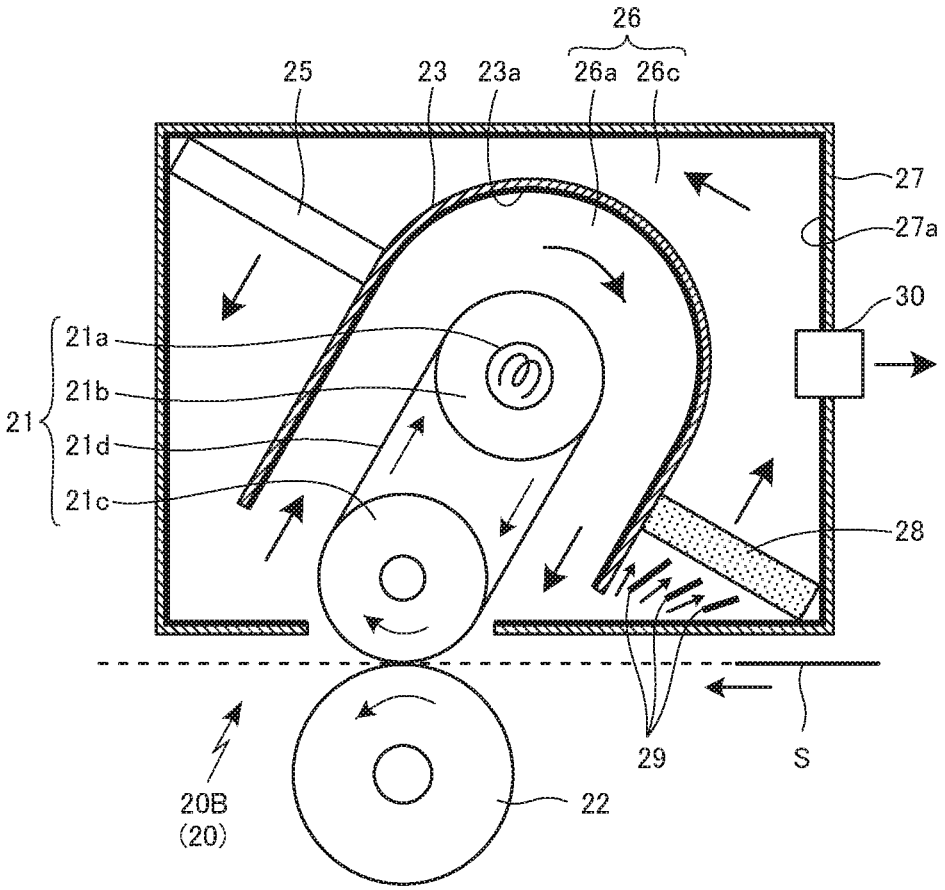
FIG. 3 is a schematic diagram illustrating how a fixing device according to a second embodiment of the invention is operated.

Next, description is made on a second fixing device 20B (20) shown in FIG. 3.

Similarly to the first fixing device 20A described above, this second fixing device 20B also has the structure where the fixing-member housing 23 is disposed on the outer side of the heat fixing member 21 including the fixing belt 21*d* entrained between the heat roller 21*b* and the fixing roller 21*c* in a manner to extend along the outer periphery of the heat fixing member 21 via the predetermined distance therebetween and where the reflection member 23*a* is attached to the inner side of the fixing-member housing 23 opposed to the heat fixing member 21 so as to enhance the heat retention of the heat fixing member 21 by reflecting the heat released from the heat fixing member 21.

On the other hand, this second fixing device 20B differs from the first fixing device 20A in the following points. The pressure-member housing 24 on the outer peripheral side of the pressure roller 22 is dispensed with. An outer peripheral housing 27 having a rectangular annular section is disposed in a manner to cover the outer periphery of the fixing-member housing 23 while a reflection member 27*a* is attached to an inner side of this outer peripheral housing 27 such that the reflection member 27*a* can reflect heat from the fixing-member housing 23 so as to enhance heat retention of space between the fixing-member housing 23 and the outer peripheral housing 27.

In this second fixing device 20B, the air blower 25 employing a fan or the like is disposed in a space defined between the outer peripheral housing 27 and the fixing-member housing 23. This air blower 25 blows air for air circulation through a circulation path 26 including an outer-peripheral side circulation portion 26*c* defined between the outer peripheral housing 27 and the fixing-member housing 23 and the fixing-member side circulation portion 26*a* defined between the fixing-member housing 23 and the heat fixing member 21.

In this second fixing device 20B, the air blown by the air blower 25 is circulated by being moved from the outer-peripheral side circulation portion 26*c* into the fixing-member side circulation portion 26*a* on an inner peripheral side of the fixing-member housing 23, through the fixing-member side circulation portion 26*a* and back into the outer-peripheral side circulation portion 26*c*.

A filter member 28 for collecting the foreign substances such as the volatile organic compounds generated during the image fixing operation is disposed at a location where the outer peripheral housing 27 is at the greatest distance from the fixing-member housing 23 in an area where the air flowing through the fixing-member side circulation portion 26*a* is returned to the outer-peripheral side circulation portion 26*c*. Further, a guide member 29 is disposed at place upstream of this filter member 28 so as to guide the air, returned from the fixing-member side circulation portion 26*a* to the outer-peripheral side circulation portion 26*c*, into the filter member 28. On the other hand, an air exhaust 30 is disposed at place downstream from the filter member 28 so as to discharge, to the outside, a part of the air flowing through the outer-peripheral side circulation portion 26*c*.

According to the second fixing device 20B, when the air blown by the air blower 25 is moved from the outer-peripheral side circulation portion 26*c* into the fixing-member side circulation portion 26*a* on the inner peripheral side of the fixing-member housing 23, through the fixing-member side circulation portion 26*a* and back into the outer-peripheral side circulation portion 26*c*, the guide member 29 guides this air flow into the filter member 28 which collects and removes the foreign substances such as the volatile organic compounds contained in this air flow.

According to the second fixing device 20B, the filter member 28 is disposed at the location where the outer peripheral housing 27 is at the greatest distance from the fixing-member housing 23. Therefore, the air flow guided into the filter member 28 is reduced in flow velocity so as to allow the filter member 28 to adequately remove the foreign substances such as the volatile organic compounds contained in the air flow.

After the foreign substances such as the volatile organic compounds contained in the air are removed by the filter member 28, the resultant air is circulated through the circulation path 26 including the outer-peripheral side circulation portion 26*c* and the fixing-member side circulation portion 26*a* while a part of the air is discharged from the circulation path 26 to the outside by means of the air exhaust 30.

Accordingly, the second fixing device 20B is adapted to prevent the foreign substances such as the volatile organic compounds generated during the image fixing operation from adhering to the reflection member 23*a* on the inner side of the fixing-member housing 23 and the reflection member 27*a* on the inner side of this outer peripheral housing 27 and thence, from absorbing the heat released from the heat fixing member 21 and the heat released from the outer periphery of the fixing-member housing 23. Thus, the reflection members 23*a*, 27*a* can adequately reflect the heat released from the heat fixing member 21 and the outer periphery of the fixing-member housing 23 so that the heat fixing member 21 and the fixing-member housing 23 are fully enhanced in the heat retention. Just as the first fixing device 20A, the second fixing device 20B as a whole can efficiently reduce the power consumption.

Although the present invention has been fully described by way of examples, it is to be noted that various changes and modifications will be apparent to those skilled in the art.

Therefore, unless otherwise such changes and modifications depart from the scope of the invention, they should be construed as being included therein.

What is claimed is:

1. A fixing device, comprising:

a heat fixing member and a pressure member opposed to the heat fixing member, and which fixes a toner image transferred to a recording medium by heating and pressing the recording medium with the transferred toner image between the heat fixing member and the pressure member, a fixing-member housing disposed on an outer peripheral side of the heat fixing member, an outer peripheral housing is disposed on an outer peripheral side of the fixing-member housing, a filter member is disposed in a first space defined between the fixing-member housing and the outer peripheral housing, and a reflection member attached to an inner side of the fixing-member housing opposed to the heat fixing member, wherein air blown by an air blower is circulated through a single continuous circulation path through the first space, through a second space between the fixing-member housing and the heat fixing member, and through the filter.

2. The fixing device according to claim 1, further comprising a reflection member attached to an inner side of the outer peripheral housing.

3. The fixing device according to claim 1, further comprising a guide member for guiding the circulated air into the filter member and which is disposed in the circulation path for circulation of the air blown by the air blower.

4. The fixing device according to claim 3, wherein the guide member has a plurality of guide plates, and distances between the plurality of the guide plates are gradually increased along the air circulation direction as approaching to the filter member.

5. The fixing device according to claim 1, further comprising an air exhaust for discharging, to the outside, the air circulated as blown by the air blower.

6. An image forming apparatus employing the fixing device according to claim 1 for fixing the toner image to the recording medium.

7. The fixing device according to claim 1, wherein the air blown by the air blower is circulated by being moved from one end of the first space, through the second space, and back into the other end of the first space.

8. The fixing device according to claim 7, wherein the filter member is disposed in the other end of the first space.

9. The fixing device according to claim 1, wherein the first space has an area where a distance between the fixing-member housing and the outer peripheral housing changes, and in the area, the filter member is disposed at place downstream in an air circulation direction from a location at the smallest distance between the fixing-member housing and the outer peripheral housing.

10. The fixing device according to claim 1, wherein the heat fixing member is rotated during fixing of the toner image while heating and pressing the recording medium, and a flow direction of the air blown by the air blower is the same as the direction of the rotation of the heat fixing member in the second space.

11. The fixing device according to claim 1, wherein the fixing-member housing is shaped along the outer periphery of the heat fixing member.

* * * * *